United States Patent [19]

Hardt et al.

[11] Patent Number: 4,951,847

[45] Date of Patent: Aug. 28, 1990

[54] TWO-CHAMBER COMPRESSED-GAS PACK

[75] Inventors: Jean Hardt, Benken; Erich Hoefling, Kreuzlingen, both of Switzerland

[73] Assignee: Swiss Aluminium Ltd., Chippis, Switzerland

[21] Appl. No.: 297,258

[22] PCT Filed: Mar. 25, 1988

[86] PCT No.: PCT/CH88/00067

§ 371 Date: Dec. 5, 1988

§ 102(e) Date: Dec. 5, 1988

[87] PCT Pub. No.: WO88/07964

PCT Pub. Date: Oct. 20, 1988

[30] Foreign Application Priority Data

Apr. 9, 1987 [CH] Switzerland ..... 1370/87

[51] Int. Cl.[5] ..... B65D 83/14

[52] U.S. Cl. ..... 222/386.5; 222/389

[58] Field of Search ..... 222/94, 129, 386.5, 222/389, 95, 130

[56] References Cited

U.S. PATENT DOCUMENTS

| | | | |
|---|---|---|---|
| 2,319,683 | 5/1943 | Hofmann . | |
| 3,592,360 | 7/1971 | Aleck | 222/95 |
| 3,620,420 | 11/1971 | Normos . | |
| 3,876,119 | 4/1975 | Lamkin | 222/389 |
| 3,945,539 | 3/1976 | Sossong | 222/386.5 |
| 3,981,418 | 9/1976 | Williamson et al. | 222/386.5 |
| 3,986,641 | 10/1976 | Casey . | |
| 4,184,608 | 1/1980 | Christensson . | |
| 4,330,289 | 5/1982 | Christensson . | |
| 4,350,272 | 9/1982 | Petterson | 222/386.5 |

FOREIGN PATENT DOCUMENTS

| | | | |
|---|---|---|---|
| 2140804 | 1/1973 | France . | |
| 2378693 | 8/1978 | France . | |
| 60279 | 1/1970 | Luxembourg . | |
| 2184491 | 6/1987 | United Kingdom | 222/105 |

*Primary Examiner*—Joseph J. Rolla
*Assistant Examiner*—Steven Reiss
*Attorney, Agent, or Firm*—Bachman & La Pointe

[57] ABSTRACT

In twin-chamber compressed gas packs, the collar of a diaphragm which invaginates during motion in the container is secured with its opening region in a fold or in the upper part of the container, in order to provide the required sealing between product chamber and working fluid chamber. The disadvantage of packs of this type is that the use of multi-part containers is mandatory and/or that a support ring incorporated in the diaphragm produces a frictional force which may be large enough to prevent ejection of the feed material because of an insufficient pressure differential between the chambers. These drawbacks are overcome by securing the entire region of the collar to the internal wall of the casing.

9 Claims, 3 Drawing Sheets

TWO-CHAMBER COMPRESSED-GAS PACK

BACKGROUND OF THE INVENTION

The invention relates to a two-chamber compressed-gas pack consisting essentially of a can body and of a concertina with a bottom and a collar reversing during movement in the can body, and to a process for producing it.

A two-chamber compressed-gas pack is a container for receiving and dispensing liquid and pasty products under pressure and consists of a rigid, usually metal outer container, namely the can body, in which a concertina with a rigid bottom and a reversible collar is fastened in such a way that two chambers are formed, one being filled with the extraction product and the other with a propellent gas under increased pressure or a pressure-generating fluid. The pressure of the propellent gas is relieved by means of a valve which is located on the product side and which allows the product to flow out of the pack when it is actuated.

The advantage of containers of this type in comparison with known spray cans is that the propellant expelling the product remains in the container and, furthermore, does not come in contact with the product. The lastmentioned fact is very important especially when the product is a foodstuff, cosmetic agent or medicine.

However, where the two-chamber compressed-gas pack is concerned, problems arise repeatedly in the region of the point of connection of the concertina to the outer container or during its handling. According to U.S. Pat. No. 3,415,425, the collar which reverses during movement in the can body is incorporated by means of its orifice edge in the bottom seam of the three-part outer container consisting of a bottom, a cylinder and a valve plate, in order to guarantee the necessary sealing between the product chamber and the propellant chamber. In a similar way, according to U.S. Pat. No. 3,620,420, the orifice region of the reversing collar is gripped in, among other things, the seam of the cover for fastening the valve plate or glued on in the upper part of the can body. In addition, the introduction of a tubular supporting ring in the region of the reversing collar is proposed, so that the latter is guided in a controlled manner and is not pressed radially inwards, which could have an influence on the discharge of the product and the sealing effect of the concertina.

The essential disadvantages of two-chamber compressed-gas packs according to the state of the art described are that multipart can bodies are absolutely unavoidable and/or that the inserted supporting ring builds up a very high frictional force which impedes the discharge of the product because of the lack of differential pressure between the chambers. Moreover, the outlay in terms of material for the concertina and possibly also the supporting ring is considerable.

SUMMARY OF THE INVENTION

The inventors therefore made it their object to design a two-chamber compressed-gas pack which does not have such disadvantages, and to develop processes for producing it.

The first part of the object is achieved by means of the features of the subject of the invention and a two-chamber compressed gas pack provided consisting essentially of a can body and of a concertina or diaphragm with a bottom and a collar reversing during movement in the can body, wherein the collar is fastened over its entire region to the inner wall of the can body.

The two-chamber compressed-gass pack according to the invention is therefore characterized in that not only the collar end is used for sealing off the chambers, with the effect that the collar can collapse radially in itself. Furthermore, at least during the period of time in which the compressed-gas pack still contains relatively large quantities of product and the propellant pressure is therefore also still very high, the sealing surface is large, at least larger than in the seal according to the state of the art described, so that, during the handling of the pack, slight deformations of the cylindrical body of the compressed-gas pack never have any influence on the impermeability of the collar reversing during movement.

The can body can be produced in a way known per se from the materials conventionally used for this. For manufacturing the concertina with the reversing collar, use is made of both plastics and ductile metallic materials and/or their composites, for example an injection-molded plastic blank, the wall of which is thinned out by thermoforming, a thermoformed plastic composite material, a deepdrawn and/or stretcher-levelled aluminum/plastic composite material or, in particular, an extruded, soft annealed and internally lacquered sleeve with a bottom having, if appropriate, a secondary shaped element, and in the last two possibilities there can be an outward doubling of the collar at the open end facing the product.

BRIEF DESCRIPTION OF THE DRAWINGS

Further features and details of the invention emerge from the diagrammatic drawing in which.

DETAILED DESCRIPTION

Figure 5:
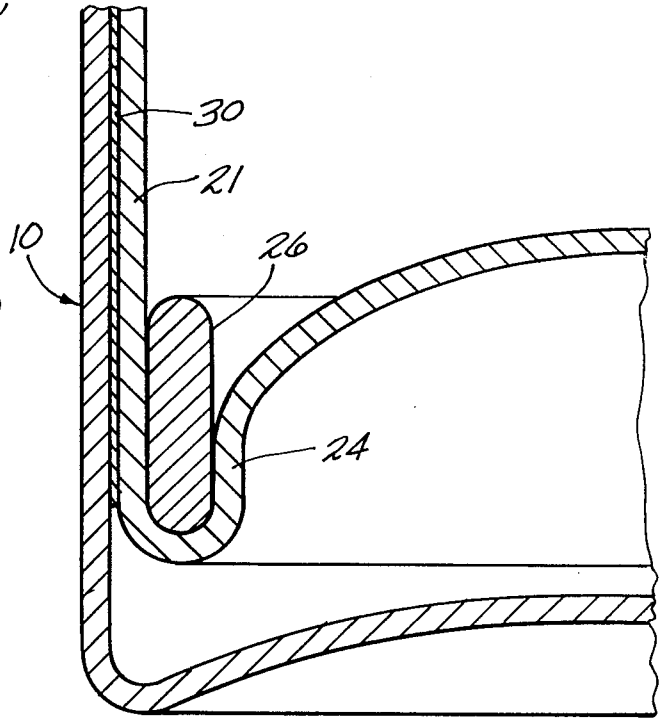
FIG. 5 shows a section through a compressed-gas pack, drawn in cutout form, in the region of the reversal of the collar.

The two-chamber compressed-gas pack according to the invention consists of a can body 10 with a bottom 6 containing a valve 5 and a valve plate 9 fastened by means of a welt 7 and containing a product extraction valve 8. The can body 10 contains a concertina 20 with a dimensionally rigid bottom 23, on which an annular or otherwise designed secondary shaped element 2 can be formed, and a collar 21. The collar 21 consisting of a flexible material is fastened over its entire outer face to the inner wall 11 of the can body 10. Fastening can, for example, be by means of a frictional and/or positive connection or by means of an adhesive 30. Two chambers are thus obtained in the interior of the can body 10, namely a chamber 12 located between the bottom 23 of the concertina 20 and the bottom 6 of the can body 10 and containing the propellent gas and a chamber 22 located between the bottom of the concertina 20 and the valve plate 9 of the can body 10 and containing the extraction product. The fastening of the collar 21 to the inner wall 11 of the can body 10 is such that, when the valve 8 is actuated, the propellent gas introduced into the chamber 12 under excess pressure can push the bottom 23 of the concertina 20 in the direction of the valve 8 as a result of a relief of pressure. The connection between the collar 21 and the inner wall 11 thereby peels off to the extent of the reversal of the collar 21 in the formed region 24 of the bottom 23. To prevent creases from forming in this region, an annular crease holder 26 (FIG. 5) can additionally be introduced into the concertina 20.

Figure 2:
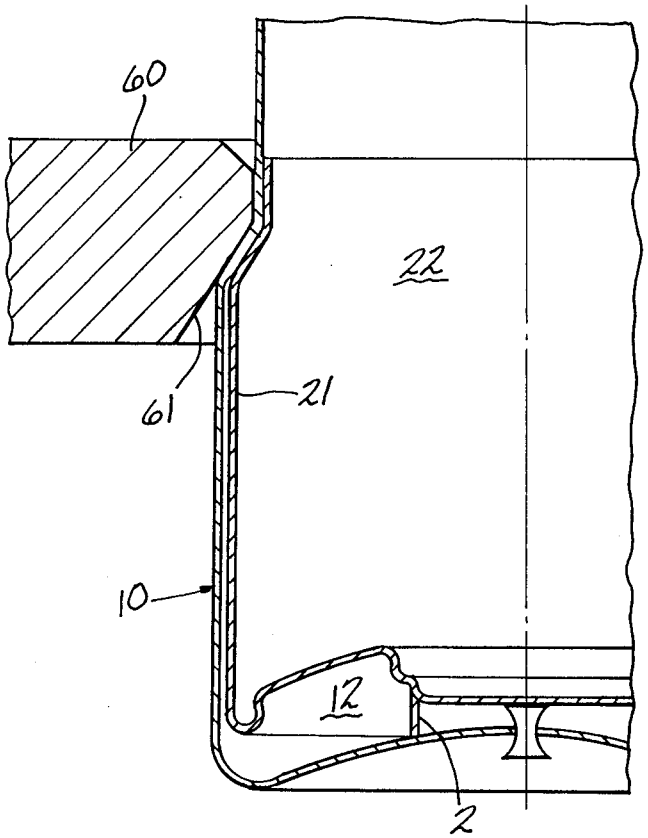
FIG. 2 shows a section through a compressed-gas pack, drawn in cutout form, during the production of the shrinkfit connection.

The fastening of the concertina 20 to the inner wall of the can body is of the greatest importance in the two-chamber compressed-gas pack according to the invention. FIG. 2 shows one fastening possibility. The concertina 20 with an outside diameter slightly less than the inside diameter of the can body 10 is pushed into the can body 10, and the can body 10 is subsequently reduced in diameter, at least in the region of the outer face of the collar 21, by means of a draw-in ring 60 with a conical entrance 61 and is thereby shrunk onto the concertina. This especially suitable process is preferably used when both the can body 10 and the concertina 20 consist of metal, particularly an aluminum material.

Figure 1:
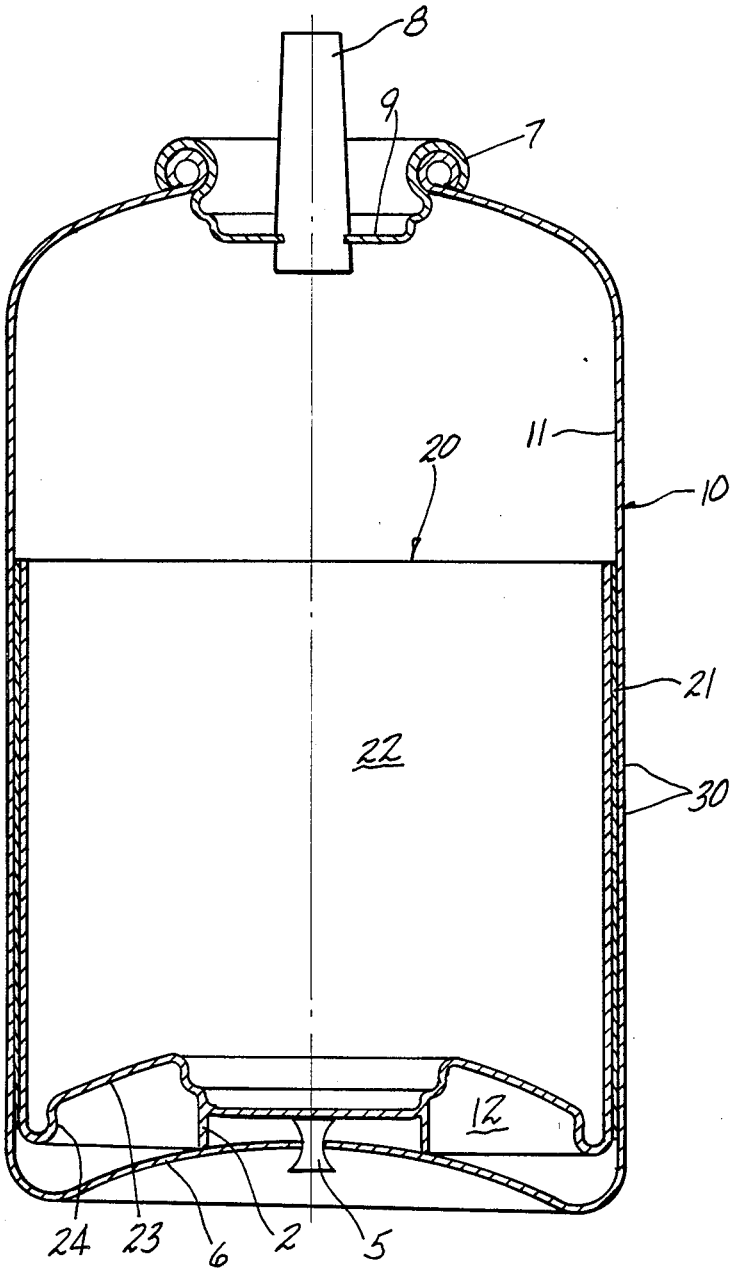
FIG. 1 shows a cross-section through a two-chamber compressed-gas pack.
Figure 3:
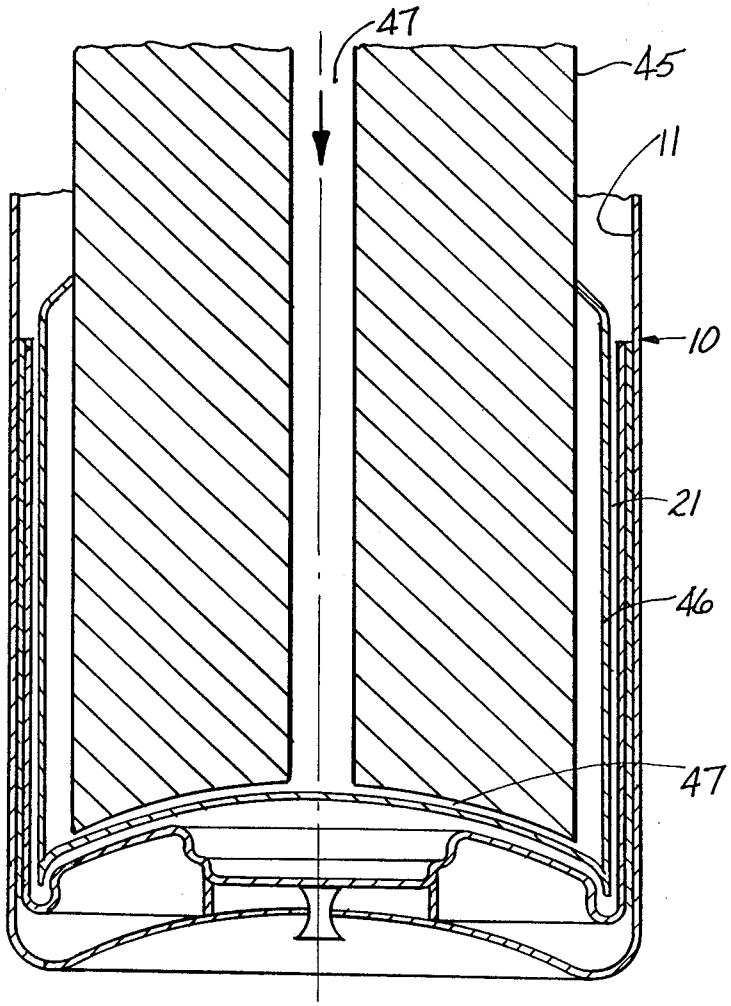
FIG. 3 shows a section through a compressed-gas pack, drawn in cutout form, during production by means of an expanding mandrel.

In a further possibility shown in FIG. 3, the collar 21 is connected to the inner wall 11 of the can body 10 because the collar 21 is pressed against the inner wall 11 of the can body 10 as a result of pressure exerted via appropriate feed means 47 on the wall 46, facing the collar 21 on the inside, of an expanding mandrel 45 introduced into the can body 10 before the valve plate 9 is mounted.

Figure 4:
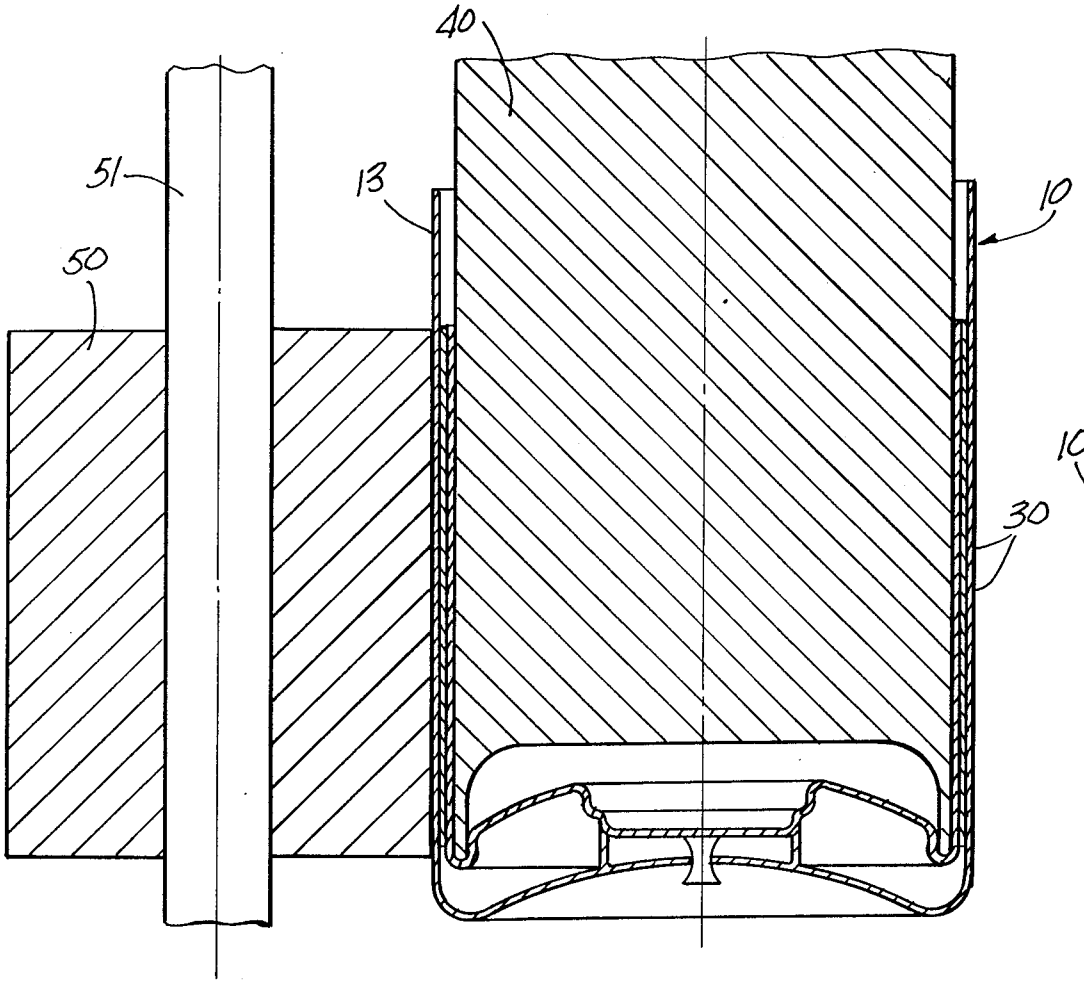
FIG. 4 shows a section through a compressed-gas pack, drawn in cutout form, during production by means of a mandrel and roller.

In yet another possibility for producing the two-chamber compressed-gas pack according to the invention shown in FIG. 4, the collar 21 and the inner wall 11 of the can body 10 are connected to one another because the concertina 20 is slipped onto a mandrel 40 having in the region of the collar 21 a diameter slightly less than the inside diameter of the concertina. If a contact adhesive is used the mandrel is at room temperature, and if a hot melt adhesive is used it is preheated. This arrangement of parts is introduced into the can body 10 before the valve plate 9 is mounted, and subsequently a roller 50 arranged rotatably on a shaft 51 is rolled on the outer wall 13 of the can body 10 in the region surrounding the collar 21.

We claim:

1. A two-chamber compressed gas pack which comprises: a cylindrical can body having an inner wall, an upper valve and a lower base; a diaphragm within said can and forming two chambers within the can, said diaphragm having an entirely rigid bottom adjacent the can base and a flexible collar adjacent the can inner wall, wherein the collar is fastened to the inner wall substantially over its entire region and wherein the collar separates from the inner wall and reverses itself during movement in the can body; said bottom including an area of transition to the collar having a formed region extending circumferentially adjacent said inner wall therein; wherein said collar reverses itself and separates from the inner wall adjacent the formed region along said fastened region and the collar bottom moves in the direction of the valve.

2. A pack according to claim 1 wherein said diaphragm is a composite.

3. A pack according to claim 2 wherein said composite is an aluminum-plastic composite.

4. A pack according to claim 1 wherein the collar is fastened to the inner wall by means of an adhesive.

5. A pack according to claim 4 wherein said adhesive is selected from the group consisting of a thermoplastic adhesive and a hot melt adhesive.

6. A pack according to claim 4 wherein at least some of the adhesive is an integral part of the collar.

7. A pack according to claim 1 wherein the formed region receives an annular crease holder preventing creasing during reversal of the collar.

8. A pack according to claim 1 wherein said diaphragm includes a secondary shaped element between the can body lower base and diaphragm bottom.

9. A pack according to claim 1 wherein the collar is fastened to the inner wall by means of a positive connection.

* * * * *